US011380261B2

(12) United States Patent
Wang

(10) Patent No.: US 11,380,261 B2
(45) Date of Patent: Jul. 5, 2022

(54) PIXEL CIRCUIT, PIXEL DRIVING METHOD AND DISPLAY DEVICE

(71) Applicants: ORDOS YUANSHENG OPTOELECTRONICS CO., LTD., Inner Mongolia (CN); BOE TECHNOLOGY GROUP CO., LTD., Beijing (CN)

(72) Inventor: Zhichong Wang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/956,645

(22) PCT Filed: Jan. 20, 2020

(86) PCT No.: PCT/CN2020/073212
§ 371 (c)(1),
(2) Date: Jun. 22, 2020

(87) PCT Pub. No.: WO2020/151657
PCT Pub. Date: Jul. 30, 2020

(65) Prior Publication Data

US 2021/0217364 A1 Jul. 15, 2021

(30) Foreign Application Priority Data

Jan. 24, 2019 (CN) ..... 201910067314.6

(51) Int. Cl.
*G09G 3/3258* (2016.01)
*G09G 3/3291* (2016.01)
*G09G 3/32* (2016.01)

(52) U.S. Cl.
CPC ..... *G09G 3/3258* (2013.01); *G09G 3/32* (2013.01)

(58) Field of Classification Search
CPC ... G09G 3/3258; G09G 3/3291; G09G 3/3233
See application file for complete search history.

(56) References Cited

U.S. PATENT DOCUMENTS 7,365,742 B2 * 4/2008 Kim ..... G09G 3/3233 315/169.3
10,139,958 B2 * 11/2018 Ding ..... G09G 3/3233
(Continued)

FOREIGN PATENT DOCUMENTS

CN 104809989 A 7/2015
CN 106652912 A 5/2017
(Continued)

OTHER PUBLICATIONS

First Office Action for Chinese Application No. 201910067314.6, dated Dec. 16, 2019, 9 Pages.
(Continued)

*Primary Examiner* — Sardis F Azongha
(74) *Attorney, Agent, or Firm* — Brooks Kushman P.C.

(57) ABSTRACT

A pixel circuit, a pixel driving method and a display device are provided. The pixel circuit includes a light emitting element, a driving circuit, an energy storage circuit, an initialization circuit, a compensation control circuit, a light emitting control circuit and a written-in control circuit. The initialization circuit writes an initialization voltage into a control end of the driving circuit under the control of a first gate driving signal so as to conduct the connection between a first end of the driving circuit and a second end of the driving circuit; the compensation control circuit is configured to conduct the connection between the control end of
(Continued)

the driving circuit and the second end of the driving circuit under the control of the second gate driving signal.

8 Claims, 7 Drawing Sheets

(56) References Cited

U.S. PATENT DOCUMENTS

| | | | | |
|---|---|---|---|---|
| 10,438,531 | B2 * | 10/2019 | Byun | G09G 3/3233 |
| 10,991,303 | B2 * | 4/2021 | Lee | G09G 3/3275 |
| 2017/0039952 | A1 | 2/2017 | Kim | |
| 2017/0116918 | A1 | 4/2017 | Dong et al. | |
| 2017/0221420 | A1 | 8/2017 | Zhu | |
| 2018/0047337 | A1 | 2/2018 | Zhu et al. | |
| 2018/0166025 | A1 | 6/2018 | Zhou et al. | |

FOREIGN PATENT DOCUMENTS

| | | | | | |
|---|---|---|---|---|---|
| CN | 106910468 | A | | 6/2017 | |
| CN | 107358917 | A | | 11/2017 | |
| CN | 207217082 | U | | 4/2018 | |
| CN | 109003574 | A | | 12/2018 | |
| CN | 109064978 | A | | 12/2018 | |
| CN | 109493794 | A | | 3/2019 | |
| CN | 109523956 | A | * | 3/2019 | G09G 3/3266 |

OTHER PUBLICATIONS

International Search Report and Written Opinion for Application No. PCT/CN2020/073212, dated Apr. 10, 2020, 10 Pages.

* cited by examiner

PIXEL CIRCUIT, PIXEL DRIVING METHOD AND DISPLAY DEVICE

CROSS-REFERENCE TO RELATED APPLICATION APPLICATIONS

This application is the U.S. national phase of PCT Application No. PCT/CN2020/073212 filed on Jan. 20, 2020, which claims priority to Chinese Patent Application No. 201910067314.6 filed on Jan. 24, 2019, which are incorporated herein by reference in their entireties.

TECHNICAL FIELD

The present disclosure relates to the field of display technology, in particular to a pixel circuit, a pixel driving method and a display device.

BACKGROUND

In a pixel circuit in a related art, since shift of a threshold voltage of a driving transistor is different, an image displayed in the entire display panel is likely to be uneven, and thus the threshold voltage compensation is required. Meanwhile, due to the hysteresis effect of the driving transistor in the pixel circuit, when a black and white picture is switched into a gray scale picture after a period of time, an afterimage may exist in an organic light emitting diode (OLED) display product in the related art, and then the afterimage exists for a period of time and disappears, namely the afterimage is a short-term afterimage, so that the problem of the short-term afterimage cannot be effectively improved in the related art.

SUMMARY

The present disclosure provides a pixel circuit including: a light emitting element comprising a first electrode and a second electrode; a driving circuit comprising a control end, a first end and a second end, and configured to connect or disconnect the first end of the driving circuit and the second end of the driving circuit under the control of the control end of the driving circuit; an energy storage circuit comprising a first end and a second end, and the first end of the energy storage circuit being connected to the control end of the driving circuit; an initialization circuit, electrically connected to a first gate line and configured to write an initialization voltage into the control end of the driving circuit under the control of a first gate driving signal output by the first gate line, so as to control the driving circuit to conduct the connection between the first end of the driving circuit and the second end of the driving circuit; a light emitting control circuit, electrically connected to a first light emitting control line and a second light emitting control line, and configured to conduct the connection between the first end of the driving circuit and a first voltage end under control of a first light emitting control signal output by the first light emitting control line, and conduct the connection between the second end of the driving circuit and the first electrode of the light emitting element under control of a second light emitting control signal output by the second light emitting control line; the second electrode of the light emitting element being connected to a second voltage end; a compensation control circuit, electrically connected to a second gate line and configured to conduct the connection between the control end of the driving circuit and the second end of the driving circuit under the control of a second gate driving signal output by the second gate line; and a written-in control circuit, electrically connected to the second gate line and the second light emitting control line, and configured to write a data voltage into the second end of the energy storage circuit under the control of the second gate driving signal and write a reference voltage into the second end of the energy storage circuit under the control of the second light emitting control signal.

In an embodiment of the present disclosure, the pixel circuit further includes a reset circuit, the reset circuit is electrically connected to the first gate line and configured to write the initialization voltage into a first electrode of the light emitting element under the control of the first gate driving signal output by the first gate line, so as to enable the light emitting element not to emit light.

In an embodiment of the present disclosure, the reset circuit includes a reset transistor; the reset transistor includes a control electrode, a first electrode and a second electrode; the control electrode of the reset transistor is connected to the first gate line, and the first electrode of the reset transistor is connected to an initialization voltage line; the second electrode of the reset transistor is connected to the first electrode of the light emitting element; the initialization voltage line is used to provide the initialization voltage.

In an embodiment of the present disclosure, the pixel circuit further includes a reset circuit; the reset circuit is electrically connected to the first gate line; the reset circuit is configured to conduct the connection between the control end of the driving circuit and the second end of the driving circuit under the control of the first gate driving signal output by the first gate line.

In an embodiment of the present disclosure, the reset circuit includes a reset transistor; the reset transistor includes a control electrode, a first electrode and a second electrode; and the control electrode of the reset transistor is connected to the first gate line, the first electrode of the reset transistor is connected to the control end of the driving circuit, and the second electrode of the reset transistor is connected to a second end of the driving circuit.

In an embodiment of the present disclosure, the driving circuit includes a driving transistor; the energy storage circuit includes a storage capacitor, and the light emitting element is an organic light emitting diode; the driving transistor includes a gate electrode, a first electrode and a second electrode; the gate electrode of the driving transistor is a control end of the driving circuit, the first electrode of the driving transistor is a first end of the driving circuit, and the second electrode of the driving transistor is a second end of the driving circuit; the storage capacitor includes a first end and a second end; the first end of the storage capacitor is a first end of the energy storage circuit, and the second end of the storage capacitor is a second end of the energy storage circuit; and the organic light emitting diode includes an anode and a cathode; the anode of the organic light emitting diode is the first electrode of the light emitting element, and the cathode of the organic light emitting diode is the second electrode of the light emitting element.

In an embodiment of the present disclosure, the initialization circuit includes an initialization transistor; the initialization transistor includes a control electrode, a first electrode and a second electrode; the control electrode of the initialization transistor is connected to the first gate line, the first electrode of the initialization transistor is connected to a control end of the driving circuit, and the second electrode of the initialization transistor is connected to an initialization voltage line; the initialization voltage line is used for inputting the initialization voltage.

In an embodiment of the present disclosure, the compensation control circuit includes a compensation control transistor; the compensation control transistor includes a control electrode, a first electrode and a second electrode; and the control electrode of the compensation control transistor is connected to the second gate line, the first electrode of the compensation control transistor is connected to the control end of the driving circuit, and the second electrode of the compensation control transistor is connected to the second end of the driving circuit.

In an embodiment of the present disclosure, the light emitting control circuit includes a first light emitting control transistor and a second light emitting control transistor; the first light emitting control transistor includes a control electrode, a first electrode and a second electrode; the control electrode of the first light emitting control transistor is connected to the first light emitting control line, the first electrode of the first light emitting control transistor is connected to the first voltage end, and the second electrode of the first light emitting control transistor is connected to the first end of the driving circuit; the second light emitting control transistor includes a control electrode, a first electrode, and a second electrode; the control electrode of the second light emitting control transistor is connected to the second light emitting control line, the first electrode of the second light emitting control transistor is connected to the second end of the driving circuit, and the second electrode of the second light emitting control transistor is connected to the first electrode of the light emitting element.

In an embodiment of the present disclosure, the written-in control circuit includes a data written-in transistor and a voltage written-in transistor, the data written-in transistor includes a control electrode, a first electrode and a second electrode; the control electrode of the data written-in transistor is connected to the second gate line, the first electrode of the data written-in transistor is connected to the data line, and the second electrode of the data written-in transistor is connected to a second end of the energy storage circuit; the voltage written-in transistor includes a control electrode, a first electrode and a second electrode; and the control electrode of the voltage written-in transistor is connected to the second light emitting control line, the first electrode of the voltage written-in transistor is connected to the reference voltage end, and the second electrode of the voltage written-in transistor is connected to the second end of the energy storage circuit.

In an embodiment of the present disclosure, the reference voltage end is the first voltage end or a ground end.

In an embodiment of the present disclosure, the first gate driving signal, the first light emitting control signal, the second gate driving signal, and the second light emitting control signal are provided by a same gate driving circuit.

The present disclosure further provides a pixel driving method applied to the above pixel circuit, a display period includes an initialization phase, a compensation phase, and a display phase set sequentially, the pixel driving method includes: in the initialization phase, writing, by the initialization circuit, the initialization voltage into the control end of the driving circuit under the control of the first gate electrode driving signal input by the first gate line, so as to control the driving circuit to conduct the connection between the first end of the driving circuit and the second end of the driving circuit; in the compensation phase, controlling the light emitting control circuit by the first light emitting control signal to conduct the connection between the first voltage end and the first end of the driving circuit, and controlling the light emitting control circuit by the second light emitting control signal to disconnect the second end of the driving circuit from the light emitting element; writing, by the written-in control circuit, the data voltage into the second end of the energy storage circuit under the control of the second gate electrode driving signal output by the second gate line; conducting, by the compensation control circuit, the connection between the control end of the driving circuit and the second end of the driving circuit under the control of the second gate driving signal; conducting, by the driving circuit, the connection between the first end of the driving circuit and the second end of the driving circuit under the control of the control end of the driving circuit, and charging the energy storage circuit through a first voltage so as to increase a voltage of the control end of the driving circuit until the driving circuit disconnects the first end and the second end; in the display phase, conducting, by the light emitting control circuit, the connection between the first voltage end and the first end of the driving circuit under the control of the first light emitting control signal, conducting, by the light emitting control circuit, the connection between the second end of the driving circuit and the first electrode of the light emitting element under the control of the second light emitting control signal, and driving, by the driving circuit, the light emitting element to emit light under the control of the control end of the driving circuit.

In an embodiment of the present disclosure, the pixel driving method further includes: in the initialization phase, the light emitting control circuit disconnecting the first voltage end from the first end of the driving circuit under the control of the first light emitting control signal, and the light emitting control circuit conducting the connection between the second end of the driving circuit and the light emitting element under the control of the second light emitting control signal.

In an embodiment of the present disclosure, the pixel circuit further includes a reset circuit; the pixel driving method further incudes: in the initialization phase, writing, by the reset circuit, the initialization voltage into the first electrode of the light emitting element under the control of the first gate driving signal output by the first gate line, so that the light emitting element does not emit light.

In an embodiment of the present disclosure, the pixel circuit further includes a reset circuit; the pixel driving method further includes: in the initialization phase, conducting, by the reset circuit, the connection between the control end of the driving circuit and the second end of the driving circuit under the control of the first gate driving signal output by the first gate line; and conducting, by the light emitting control circuit, the connection between the second end of the driving circuit and the first electrode of the light emitting element under the control of the second light emitting control signal, so that the initialization voltage is written into the first electrode of the light emitting element, and the light emitting element does not emit light.

The present disclosure further provides a display device including a plurality of pixel circuits in N rows and a plurality of columns, N is an integer greater than 1.

In an embodiment of the present disclosure, the display device further includes a gate driving circuit, the gate driving circuit includes N stages of gate driving unit circuits and a phase inversion circuit; the nth stage of the gate driving unit circuit is configured to provide the first gate driving signal to pixel circuits in the nth row and provide the second gate driving signal to pixel circuits in the (n−1) th row, n is an integer greater than 1 and less than or equal to N; the first stage of the gate driving unit circuit is configured to provide the first gate driving signal to pixel circuits in the first row; the phase inversion circuit is configured to perform phase inversion on the first gate driving signal to obtain the first light emitting control signal, and perform phase inversion on the second gate driving signal to obtain the second light emitting control signal.

In an embodiment of the present disclosure, the display device further includes a gate driving circuit, the gate driving circuit includes N stages of gate driving unit circuits; the nth stage of the gate driving unit circuit is configured to provide the first gate driving signal and the first light emitting control signal to pixel circuits in the nth row, and provide the second gate driving signal and the second light emitting control signal to pixel circuits in the (n−1) th row, and n is an integer greater than 1 and less than or equal to N; the first stage of gate driving unit circuit is configured to provide the first gate driving signal and the first light emitting control signal to pixel circuits in the first row.

DETAILED DESCRIPTION

The technical solutions in the embodiments of the present disclosure will be described clearly and completely with reference to the drawings in the embodiments of the present disclosure, and it is obvious that the embodiments described are only some embodiments of the present disclosure, rather than all embodiments. All other embodiments, which can be derived by a person skilled in the art from the embodiments disclosed herein without making any creative effort, shall fall within the protection scope of the present disclosure.

The transistors used in all embodiments of the present disclosure may be transistors, thin film transistors, or field effect transistors or other devices with the same characteristics. In the embodiments of the present disclosure, to distinguish two electrodes of a transistor except for a control electrode, one electrode is referred to as a first electrode, and the other electrode is referred to as a second electrode.

In practical operation, for a transistor, the control electrode may be a base electrode, the first electrode may be a collector electrode, and the second electrode may be an emitter electrode. Alternatively, the control electrode may be a base electrode, the first electrode may be an emitter electrode, and the second electrode may be a collector electrode.

In practical operation, when the transistor is a thin film transistor or a field effect transistor, the control electrode may be a gate electrode, the first electrode may be a drain electrode, and the second electrode may be a source electrode. Alternatively, the control electrode may be a gate electrode, the first electrode may be a source electrode, and the second electrode may be a drain electrode.

Figure 1:
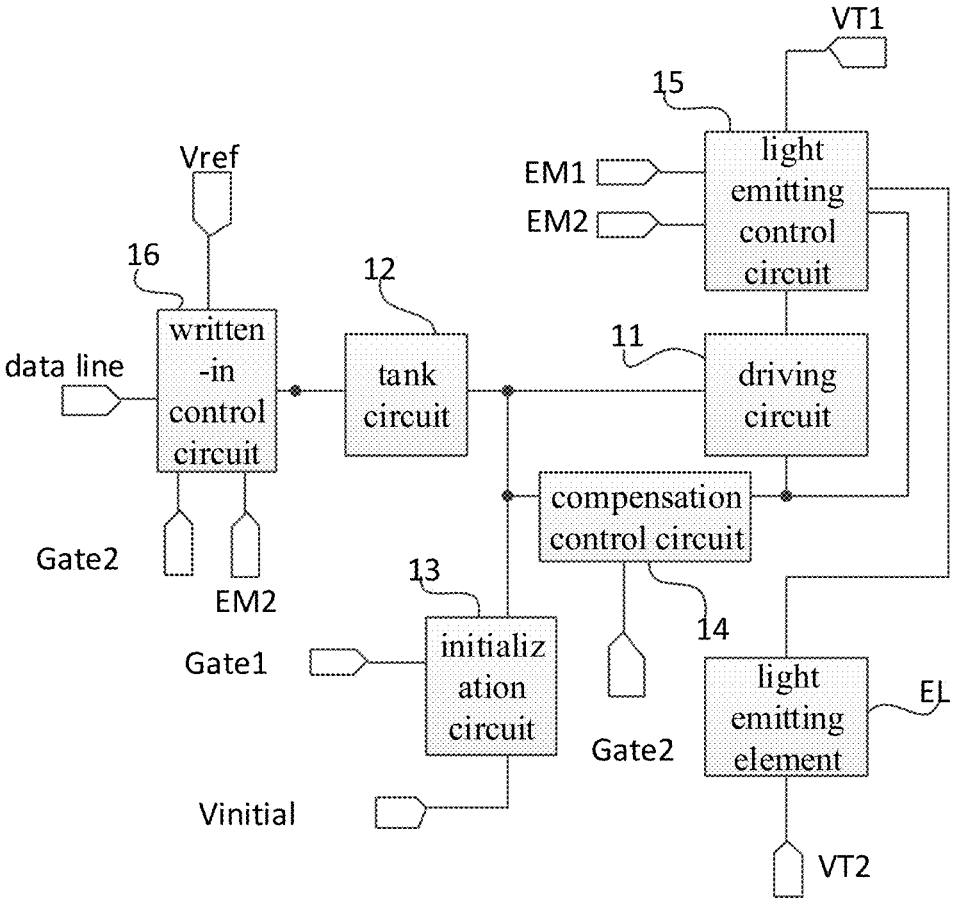
FIG. 1 is a block diagram of a pixel circuit according to an embodiment of the disclosure.

As shown in FIG. 1, a pixel circuit according to an embodiment of the present disclosure includes a light emitting element EL, a driving circuit 11, and a tank circuit 12. The driving circuit 11 is used for connecting or disconnecting the first end of the driving circuit 11 and the second end of the driving circuit 11 under the control of the control end of the driving circuit 11. A first end of the tank circuit 12 is connected to a control end of the driving circuit 11.

The pixel circuit according to the embodiment of the present disclosure further includes an initialization circuit 13, a compensation control circuit 14, a light emitting control circuit 15, and a written-in control circuit 16.

The initialization circuit 13 is respectively connected to a first gate line Gate1, an initialization voltage line for inputting an initialization voltage Vinitial, and the control end of the driving circuit 11, and is configured to control to write the initialization voltage Vinitial into the control end of the driving circuit 11 under the control of the first gate driving signal output by the first gate line Gate1, so as to control the driving circuit 11 to enable the connection between the first end of the driving circuit 11 and the second end of the driving circuit 11.

The light emitting control circuit 15 is connected to a first light emitting control line EM1, a second light emitting control line EM2, a first voltage end VT1, the first end of the driving circuit 11, and the second end of the driving circuit 11, respectively, and is configured to conduct, under the control of a first light emitting control signal output by the first light emitting control line EM1, connection between the first end of the driving circuit 11 and the first voltage end VT1, and to conduct, under the control of a second light emitting control signal output by the second light emitting control line EM2, connection between the second end of the driving circuit 11 and the first end of the light emitting element EL; the second electrode of the light emitting element EL is connected to a second voltage end VT 2.

The compensation control circuit 14 is respectively connected to the second gate line Gate2, the control end of the driving circuit 11, and the second end of the driving circuit 11, and is configured to conduct, under the control of a second gate driving signal output by the second gate line Gate 2, connection between the control end of the driving circuit 11 and the second end of the driving circuit 11.

The written-in control circuit 16 is respectively connected to the second gate line Gate2, the second emitting control line EM2, the data line Data, the reference voltage line for inputting the reference voltage Vref, and the second end of the tank circuit 12, and is configured to write the data voltage on the data line Data into the second end of the tank circuit 12 under the control of the second gate driving signal, and write the reference voltage Vref into the second end of the tank circuit 12 under the control of the second emitting control signal.

The pixel circuit according to the embodiment of the present disclosure sets the potential of the control end of the driving circuit 11 to be the initialization voltage Vinitial in an initialization phase by using the initialization circuit 13, so that the driving transistor included in the driving circuit 11 is in an on-bias state, and the driving transistor included in the driving circuit 11 starts to perform compensation and data writing-in from the on state no matter whether the data voltage in the previous frame of picture display time corresponds to black or white, and in the initialization phase included in each display period, the gate voltage and the source voltage of the driving transistor included in the driving circuit 11 are both fixed values, thereby ensuring the consistency of initialization and improving the short-term afterimage problem caused by the hysteresis effect. In addition, in an embodiment of the present disclosure, the initialization circuit 13, the compensation control circuit 14, the light emitting control circuit 15, and the written-in control circuit 16 cooperate to compensate for the threshold of the driving transistor included in the driving circuit 11.

In a specific implementation, the first voltage end VT1 may be a power voltage end, and the second voltage end VT2 may be a low voltage end, but not limited thereto.

When the pixel circuit is in operation, a display period includes an initialization phase, a compensation phase and a display phase which are sequentially arranged.

In the initialization phase, the initialization circuit 13 writes the initialization voltage Vinitial into the control end of the driving circuit 11 under the control of the first gate driving signal input by the first gate line Gate1, so as to control the driving circuit 11 to be able to conduct the connection between the first end and the second end of the driving circuit 11, so as to enable the driving transistor included in the driving circuit 11 to be in an on state. The light emitting control circuit 15 disconnects the first voltage end VT1 from the first end of the driving circuit 11 under the control of a first light emitting control signal outputted from a first light emitting control line EM1, and conducts the connection between the second end of the driving circuit 11 and the first electrode of the light emitting element EL under the control of the second light emitting control signal outputted from a second light emitting control line EM 2.

In the compensation phase, the light emitting control circuit 15 conducts the connection between the first voltage end VT1 and the first end of the driving circuit 11 under the control of the first light emitting control signal, and the light emitting control circuit 15 disconnects the second end of the driving circuit 11 from the first electrode of the light emitting element EL under the control of the second light emitting control signal. The written-in control circuit 16 writes the data voltage into the second end of the tank circuit 12 under the control of the second gate driving signal output by the second gate line Gate 2. The compensation control circuit 14 conducts the connection between the control end of the driving circuit 11 and the second end of the driving circuit 11 under the control of the second gate driving signal, and the driving circuit 11 conducts the connection between the first end of the driving circuit 11 and the second end of the driving circuit 11 under the control of the control end of the driving circuit 11, so as to charge the tank circuit 12 with the first voltage input by the first voltage end VT1, so as to raise a voltage on the control end of the driving circuit 11 until the driving circuit 11 disconnects the first end from the second end, so that a potential at the control end of the driving circuit 11 is related to the threshold voltage of the driving transistor in the driving circuit 11, thereby implementing the threshold voltage compensation.

In the display phase, the light emitting control circuit 15 conducts the connection between the first voltage end VT1 and the first end of the driving circuit 11 under the control of the first light emitting control signal, the light emitting control circuit 15 conducts the connection between the second end of the driving circuit 11 and the first electrode of the light emitting element EL under the control of the second light emitting control signal, and the driving circuit 11 drives the light emitting element EL to emit light under the control of the control end of the driving circuit 11.

According to an embodiment, the pixel circuit of the present disclosure may further include a reset circuit. The reset circuit is used for writing an initialization voltage into a first electrode of the light emitting element under the control of a first gate driving signal output by the first gate line so as to enable the light emitting element not to emit light.

Figure 2:
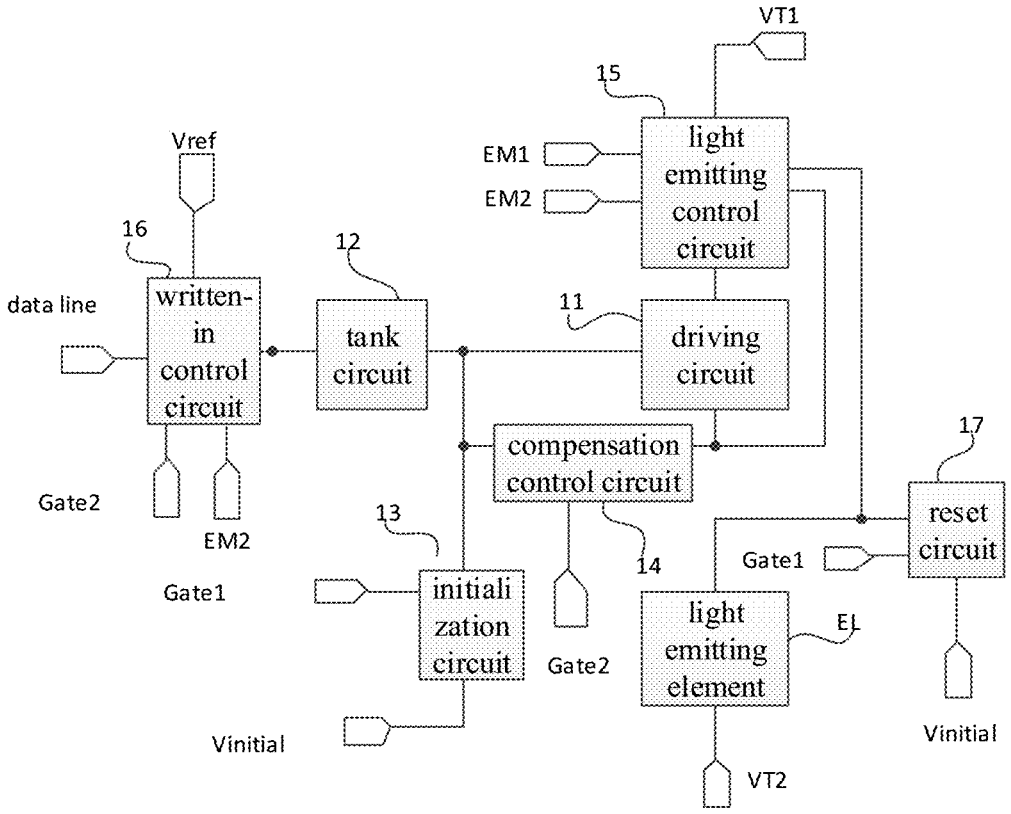
FIG. 2 is another block diagram of a pixel circuit according to an embodiment of the disclosure.

As shown in FIG. 2, on the basis of the embodiment of the pixel circuit shown in FIG. 1, the pixel circuit according to the embodiment of the disclosure may further include a reset circuit 17. The reset circuit 17 is respectively connected to the first gate line Gate1, the initialization voltage line, and the first electrode of the light emitting element EL, and is configured to write the initialization voltage Vinitial into the first electrode of the light emitting element EL under the control of the first gate driving signal, so that the light emitting element EL does not emit light, and the residual charge of the first electrode of the light emitting element EL does not affect the display.

Specifically, the reset circuit may include a reset transistor; a control electrode of the reset transistor is connected with the first gate line, and a first electrode of the reset transistor is connected with an initialization voltage line; a second electrode of the reset transistor is connected to a first electrode of the light emitting element; the initialization voltage line is used to provide the initialization voltage.

According to another embodiment, the pixel circuit of the present disclosure may further include a reset circuit. The reset circuit is used for conducting the connection between the control end of the driving circuit and the second end of the driving circuit under the control of the first gate driving signal output by the first gate line.

Figure 3:
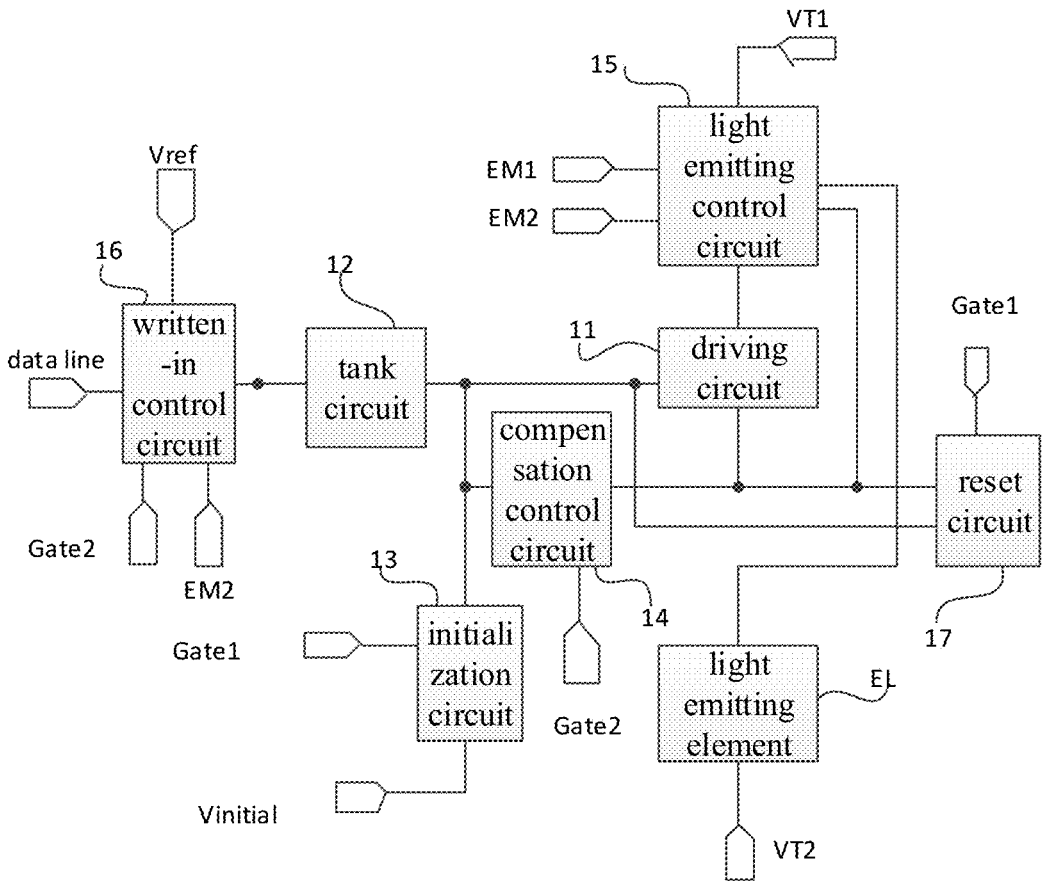
FIG. 3 is yet another block diagram of a pixel circuit according to an embodiment of the present disclosure.

As shown in FIG. 3, on the basis of the embodiment of the pixel circuit shown in FIG. 1, the pixel circuit according to the embodiment of the disclosure may further include a reset circuit 17. The reset circuit 17 is respectively connected to the first gate line Gate1, the control end of the driving circuit 11, and the second end of the driving circuit 11, and is configured to conduct the connection between the control end of the driving circuit 11 and the second end of the driving circuit 11 under the control of the first gate driving signal output by the first gate line Gate1, so as to control to write the initialization voltage Vinitial into the second end of the driving circuit 11.

In the initialization phase, the reset circuit 17 writes Vinitial into the second end of the driving circuit 11, and in this case, the light emitting control circuit 15 writes Vinitial into the first end of the light emitting element EL by conducting the connection between the second end of the driving circuit 11 and the first end of the light emitting element EL under the control of the second light emitting control signal output by the second light emitting control line EM2, so that the light emitting element EL does not emit light, and the residual charge of the first end of the light emitting element EL does not affect the display.

Specifically, the reset circuit may include a reset transistor; a control electrode of the reset transistor is connected to the first gate line, and a first electrode of the reset transistor is connected to a second end of the driving circuit; and a second electrode of the reset transistor is connected to a second end of the driving circuit.

Specifically, the driving circuit may include a driving transistor; the energy storage circuit may include a storage capacitor, and the light emitting element may be an organic light emitting diode.

A gate electrode of the driving transistor is the control end of the driving circuit, a first electrode of the driving transistor is the first end of the driving circuit, and a second electrode of the driving transistor is the second end of the driving circuit.

A first end of the storage capacitor is a first end of the energy storage circuit, and a second end of the storage capacitor is a second end of the energy storage circuit.

An anode of the organic light emitting diode is a first electrode of the light emitting element, and a cathode of the organic light emitting diode is a second electrode of the light emitting element.

Specifically, the initialization circuit may include an initialization transistor. A control electrode of the initialization transistor is connected to the first gate line, a first electrode of the initialization transistor is connected to the control end of the driving circuit, and a second electrode of the initialization transistor is connected to an initialization voltage line; the initialization voltage line is used for inputting an initialization voltage.

Specifically, the compensation control circuit may include a compensation control transistor; and a control electrode of the compensation control transistor is connected to the second gate line, a first electrode of the compensation control transistor is connected to the control end of the driving circuit, and a second electrode of the compensation control transistor is connected to the second end of the driving circuit.

Specifically, the light emitting control circuit may include a first light emitting control transistor and a second light emitting control transistor. A control electrode of the first light emitting control transistor is connected to the first light emitting control line, a first electrode of the first light emitting control transistor is connected to the first voltage end, and a second electrode of the first light emitting control transistor is connected to the first end of the driving circuit. A control electrode of the second light emitting control transistor is connected to the second light emitting control line, a first electrode of the second light emitting control transistor is connected to the second end of the driving circuit, and a second electrode of the second light emitting control transistor is connected to the first electrode of the light emitting element.

Specifically, the written-in control circuit may include a data written-in transistor and a voltage written-in transistor. A control electrode of the data written-in transistor is connected to the second gate line, a first electrode of the data written-in transistor is connected to the data line, and a second electrode of the data written-in transistor is connected with the second end of the energy storage circuit. A control electrode of the voltage writing transistor is connected to the second light emitting control line, a first electrode of the voltage written-in transistor is connected to the reference voltage end, and a second electrode of the voltage written-in transistor is connected to the second end of the energy storage circuit.

In a specific implementation, the reference voltage end may be the first voltage end. Alternatively, the reference voltage end may be a ground end, but is not limited thereto.

In specific implementation, the reference voltage Vref may also be other adjustable voltages.

When the reference voltage end is the first voltage end, one voltage end can be reduced, so that pixel per inch (PPI) can be increased.

Optionally, the first gate driving signal, the first light emitting control signal, the second gate driving signal, and the second light emitting control signal are provided by the same gate driving circuit.

Optionally, the gate driving signal and the light emitting control signal are provided by the same gate driving circuit, so that the layout space of a Gate On Array (GOA) can be reduced, the frame of the display panel is reduced, and the narrow frame is favorably realized.

Optionally, the first gate driving signal and the first light emitting control signal are inverted in phase, the second gate driving signal and the second light emitting control signal are inverted in phase, the first light emitting control signal can be obtained by performing an inversion operation on the first gate driving signal output by the gate driving circuit, the second light emitting control signal can be obtained by performing an inversion operation on the second gate driving signal output by the gate driving circuit, and light emitting control can be realized without using a separate light emitting GOA for generating the light emitting control signal, which is beneficial to realizing a narrow frame.

The driving signals used by an OLED pixel circuit in the related art are from a gate driving GOA and a light emitting control GOA, that is, two GOAs are required for a display device in the related art, and different from the OLED pixel circuit in the related art, the driving signals used by the pixel circuit in the embodiment of the disclosure may be output from a group of GOA units (that is, the light emitting control signals in the same row may be obtained by implementing an inversion operation on the gate driving signals), which may reduce the use of a group of GOAs, thereby reducing the GOA layout space, and reducing the frame size, and facilitating the implementation of a narrow frame.

The pixel circuit according to the present disclosure is described below with reference to four specific embodiments.

Figure 4:
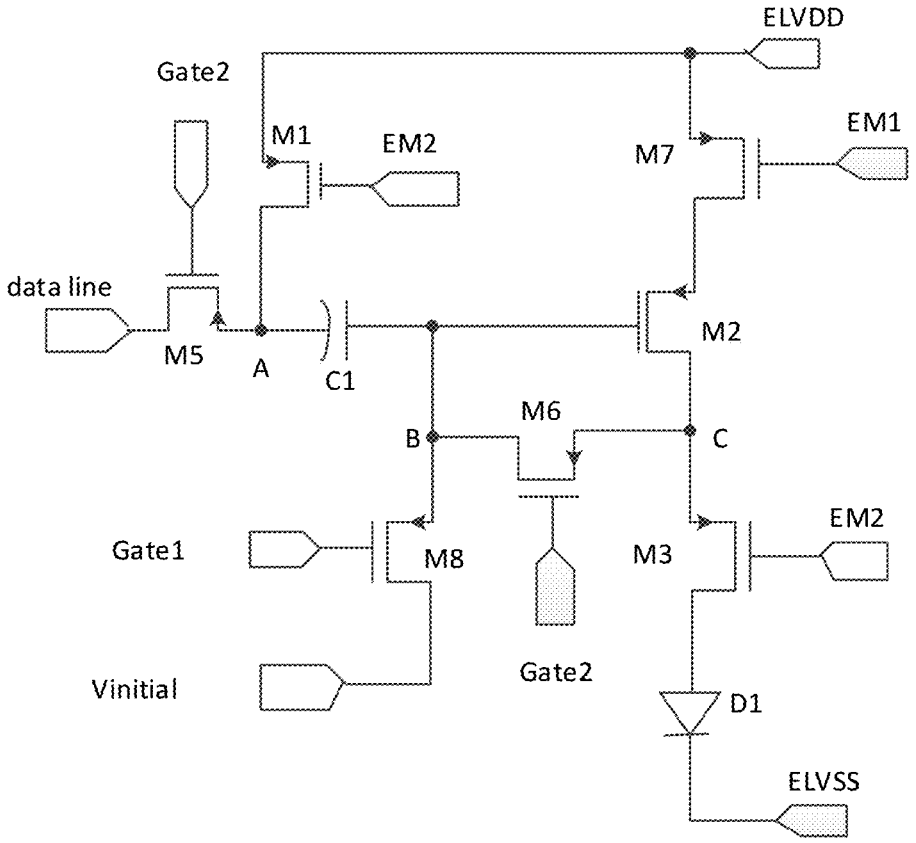
FIG. 4 is a circuit diagram of a first embodiment of a pixel circuit according to the present disclosure.

As shown in FIG. 4, a first specific embodiment of the pixel circuit according to the present disclosure includes an organic light emitting diode D1, a driving circuit, a tank circuit, an initialization circuit, a compensation control circuit, a light emitting control circuit, and a written-in control circuit.

The driving circuit includes a driving transistor M2; the initialization circuit includes an initialization transistor M8; the compensation control circuit includes a compensation control transistor M6; the light emitting control circuit includes a first light emitting control transistor M7 and a second light emitting control transistor M3; the written-in control circuit may include a data written-in transistor M5 and a voltage written-in transistor M1; the energy storage circuit includes a storage capacitor C1.

The gate electrode of the initialization transistor M8 is connected to a first gate line Gate1, the source electrode of the initialization transistor M8 is connected to the gate electrode of the driving transistor M2, and the drain electrode of the initialization transistor M8 is connected to the initialization voltage line; the initialization voltage line is used for inputting initialization voltage Vinitial.

The gate electrode of the compensation control transistor M6 is connected to a second gate line Gate2, the drain electrode of the compensation control transistor M6 is connected to the gate electrode of the driving transistor M2, and the source electrode of the compensation control transistor M6 is connected to the drain electrode of the driving transistor M2.

The gate electrode of the first light emitting control transistor M7 is connected to the first light emitting control line EM1, the source electrode of the first light emitting control transistor M7 is connected to a power supply voltage end, and the drain electrode of the first light emitting control transistor M7 is connected to a source electrode of the driving transistor M2; the power supply voltage end is used for inputting power supply voltage ELVDD.

The gate electrode of the second emitting control transistor M3 is connected to the second emitting control line EM2, the source electrode of the second emitting control transistor M3 is connected to the drain electrode of the driving transistor M2, and the drain electrode of the second emitting control transistor M3 is connected to an anode of the organic light emitting diode D1.

A first end of the storage capacitor C1 is connected to the gate electrode of the driving transistor M2.

The gate electrode of the data written-in transistor M5 is connected to the second gate line Gate2, the drain electrode of the data written-in transistor M5 is connected to the data line Data, and the source electrode of the data written-in transistor M5 is connected to the second end of the storage capacitor C1.

The gate electrode of the voltage written-in transistor M1 is connected to the second light emitting control line EM2, the source electrode of the voltage written-in transistor M1 is connected to the power supply voltage end, and the drain electrode of the voltage written-in transistor M1 is connected to the second end of the storage capacitor C1.

The cathode of the organic light emitting diode D1 is connected to a low voltage end for inputting a low voltage ELVSS.

In the first embodiment shown in FIG. 4, the reference voltage end is a power voltage end, but not limited thereto.

In FIG. 4, a first node A is a node connected to the second end of C1, a second node B is a node connected to the gate electrode of M2, and a third node C is a node connected to the drain electrode of M2.

In the first embodiment of the pixel circuit, all the transistors are p-type transistors, but not limited thereto; in the first embodiment, the first voltage end is a power voltage end, the second voltage end is a low voltage end, and the reference voltage end is the power voltage end.

Figure 5:
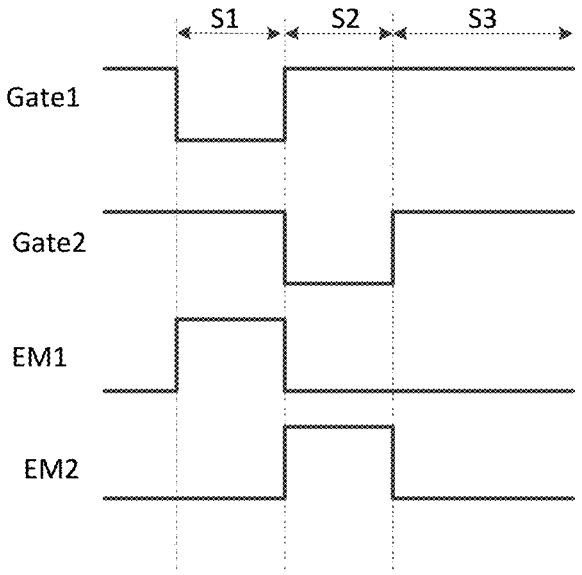
FIG. 5 is a timing sequence diagram of a pixel circuit according to an embodiment of the present disclosure.

As shown in FIG. 5, when the pixel circuit of the present disclosure as shown in FIG. 4 is in operation, in the initialization phase S1, both Gate1 and EM2 output a low level, both Gate2 and EM1 output a high level, M1, M3 and M8 are all turned on, ELVDD is written into the first node A, Vinitial is written into the second node B, the gate voltage of M2 is initialized, so that M2 is in an On-Bias (On) state, and in the initialization phase S1 included in each display period, the gate voltage and the source voltage of the driving transistor M2 are both fixed values, so that the consistency of initialization is ensured, and then, no matter any gray-scale picture is lighted, the gray-scale picture is lighted from the same level, the problem of short-term afterimage can be improved.

In the compensation phase S2, both Gate2 and EM1 output a low level, both Gate1 and EM2 output a high level, M5, M6 and M7 are all turned on, the data voltage Vdata output by Data is written into the first node A, ELVDD is written into the second node B, M2 is turned on, C1 is charged by ELVDD to boost the voltage of the gate electrode of M2 until the voltage of the gate electrode of M2 becomes ELVDD+Vth, M2 is turned off, and Vth is the threshold voltage of M2.

In the display phase S3, both Gate1 and Gate2 output a high level, both EM1 and EM2 output a low level, both M7 and M3 are turned on, M1 is turned on, ELVDD is written into the first node A, the voltage of the second node B is coupled to change to ELVDD+Vth+ELVDD−Vdata, and M2 is turned on to drive D1 to emit light, the light emitting current of D1 is I=½*K(Vgs−Vth) 2=½*K(ELVDD−Vdata)$^2$, it is seen that compensation for the threshold voltage of the driving transistor M2 is achieved, where K is a current coefficient; Vgs is the gate-source voltage of M2.

As can be seen from FIG. 5, the first gate driving signal output by Gate1 is inverted in phase with the first light emitting control signal output by EM1, and the second gate driving signal output by Gate2 is inverted in phase with the second light emitting control signal output by EM2, so that the first gate driving signal and the second gate driving signal can be generated by one gate driving circuit, and the first light emitting control signal and the second light emitting control signal can be generated by combining one inverter, which can reduce the light emitting GOA used for generating the light emitting control signal, and is beneficial to realizing a narrow bezel.

In specific implementation, when all of M7, M3 and M1 are n-type transistors, transistors with gate electrodes connected to Gate1 and transistors with gate electrodes connected to Gate2 are p-type transistors, a first light emitting control signal output by EM1 is the same as a first gate driving signal, a second light emitting control signal output by EM2 is the same as a second gate driving signal, and a gate driving circuit can be used for gate driving and light emitting control, so that one light emitting GOA for generating the light emitting control signal can be reduced, and a narrow bezel can be realized.

Figure 6:
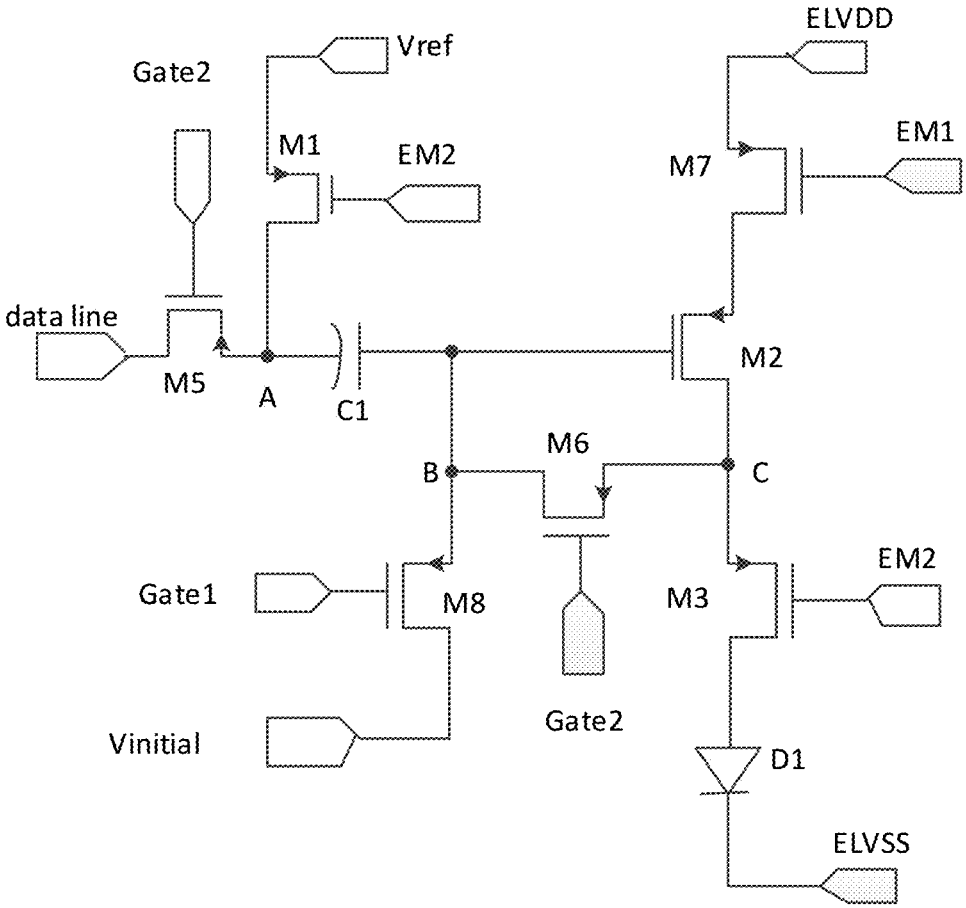
FIG. 6 is another circuit diagram of a pixel circuit according to an embodiment of the present disclosure.

FIG. 6 is a circuit diagram of a pixel circuit according to an embodiment of the present disclosure. The pixel circuit shown in FIG. 6 differs from the pixel circuit shown in FIG. 4 only in that: the source electrode of M1 is connected to the reference voltage Vref, for example Vref may be 0, and then in the display phase S3, the light emitting current of D1 is I=½*k(vdata)$^2$, and at the same time of threshold voltage compensation, the IR Drop of ELVDD is compensated (IR Drop is a phenomenon that the voltage of the power supply and ground network in the integrated circuit drops or rises).

Figure 7:
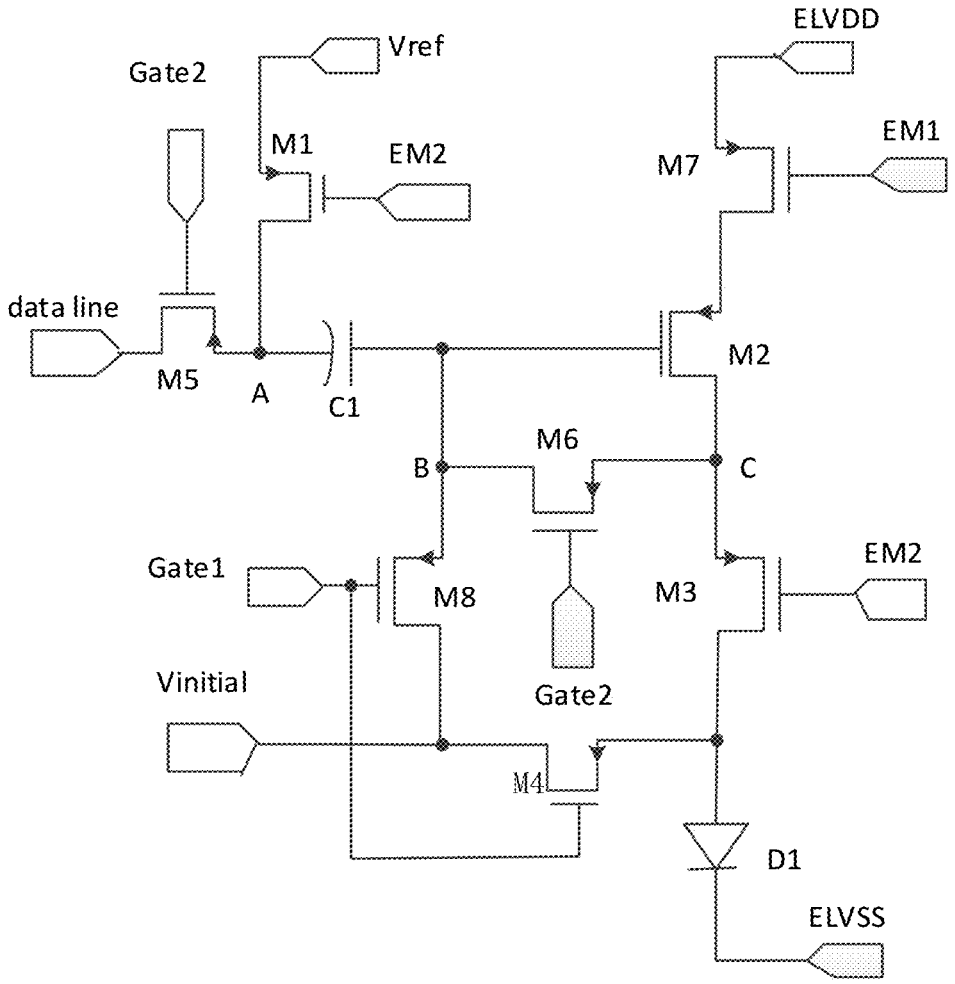
FIG. 7 is yet another circuit diagram of a pixel circuit according to an embodiment of the present disclosure.

FIG. 7 is a circuit diagram of a pixel circuit according to an embodiment the present disclosure. The pixel circuit shown in FIG. 7 differs from the pixel circuit shown in FIG. 4 only in that: the pixel circuit of the present disclosure further includes a reset circuit. The reset circuit includes a reset transistor M4. The gate electrode of the reset transistor M4 is connected to the first gate line Gate1, and the drain electrode of the reset transistor M4 is connected to an initialization voltage line; the source electrode of the reset transistor M4 is connected to the anode of the organic light emitting diode D1; the initialization voltage line is used for providing the initialization voltage Vinitial.

In the pixel circuit shown in FIG. 7, M4 is a p-type transistor, but not limited thereto.

When the pixel circuit disclosed by the disclosure is in operation, in an initialization phase, the Gate1 outputs a low level, the M4 is turned on to set the anode voltage of the D1 to Vinitial, so that the D1 does not emit light, and thus, the residual charges on the anode of the D1 do not affect the display.

Figure 8:
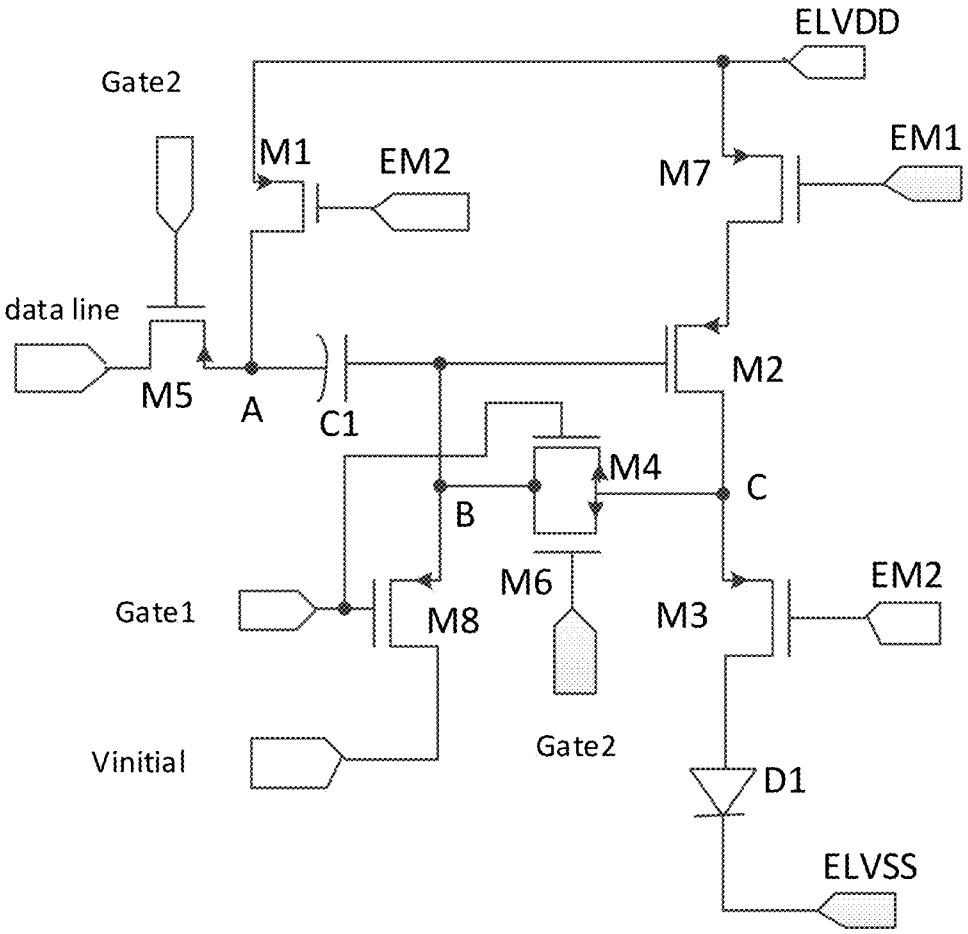
FIG. 8 is still yet another circuit diagram of a pixel circuit according to an embodiment of the present disclosure.

FIG. 8 is a circuit diagram of a pixel circuit according to an embodiment of the present disclosure. The pixel circuit shown in FIG. 8 differs from the pixel circuit shown in FIG. 4 only in that: the pixel circuit of the present disclosure further includes a reset circuit. The reset circuit includes a reset transistor M4. The gate electrode of the reset transistor M4 is connected to the first gate line Gate1, and the drain electrode of the reset transistor M4 is connected to the gate electrode of the driving transistor M2; the source electrode of the reset transistor M4 is connected to the drain electrode of the driving transistor M2.

In the pixel circuit shown in FIG. 8, M4 is a p-type transistor, but not limited thereto.

In the pixel circuit shown in FIG. 8 of the present disclosure, during the initialization phase, Gate1 outputs low level, M4 is turned on, and since both M8 and M3 are turned on, Vinitial is written into the anode of D1, so that D1 does not emit light, and thus the residual charges on the anode of D1 do not affect the display.

The pixel driving method described in the embodiment of the present disclosure is applied to the above-mentioned pixel circuit, the display period includes an initialization phase, a compensation phase, and a display phase that are sequentially set, and the pixel driving method includes the following steps.

In the initialization phase, the initialization circuit writes an initialization voltage into a control end of the driving circuit under the control of a first gate electrode driving signal input by a first gate line so as to control the driving circuit to conduct connection between a first end of the driving circuit and a second end of the driving circuit.

In the compensation phase, the light emitting control circuit is controlled by a first light emitting control signal to conduct the connection between a first voltage end and a first end of the driving circuit, and the light emitting control circuit is controlled by a second light emitting control signal to disconnect a second end of the driving circuit from the light emitting element; the written-in control circuit writes the data voltage into the second end of the energy storage circuit under the control of a second gate electrode driving signal output by the second gate line; the compensation control circuit controls to conduct the connection between the control end of the driving circuit and the second end of the driving circuit under the control of the second gate driving signal, the driving circuit conducts the connection between the first end of the driving circuit and the second end of the driving circuit under the control of the control end of the driving circuit, and the energy storage circuit is charged through first voltage so as to boost the voltage of the control end of the driving circuit until the driving circuit disconnects the first end from the second end.

In the display phase, the light emitting control circuit conducts the connection between the first voltage end and the first end of the driving circuit under the control of the first light emitting control signal, the light emitting control circuit conducts the connection between the second end of the driving circuit and the first electrode of the light emitting element under the control of the second light emitting control signal, and the driving circuit drives the light emitting element to emit light under the control of the control end of the driving circuit.

In the pixel driving method according to the embodiment of the disclosure, the initialization circuit is adopted to set the potential of the control end of the driving circuit to the initialization voltage in the initialization phase, so that the driving transistor included in the driving circuit is in an on-bias (on) state, and the driving transistor included in the driving circuit 11 starts to perform compensation and data writing from the on state no matter whether the data voltage of the previous frame of picture display time corresponds to black or white, and in the initialization phase included in each display period, the gate voltage and the source voltage of the driving transistor included in the driving circuit 11 are both fixed values, thereby ensuring the consistency of initialization and improving the short-term afterimage problem caused by hysteresis effect; in the pixel driving method according to the embodiment of the present disclosure, the initialization circuit, the compensation control circuit, the light emitting control circuit, and the written-in control circuit 16 cooperate with each other to compensate the threshold of the driving transistor included in the driving circuit.

In specific implementation, the pixel driving method according to the embodiment of the present disclosure may further include: in the initialization phase, the light emitting control circuit disconnects the first voltage end from the first end of the driving circuit under the control of the first light emitting control signal, and the light emitting control circuit conducts the connection between the second end of the driving circuit and the light emitting element under the control of the second light emitting control signal.

According to a specific embodiment, the pixel circuit may further include a reset circuit; the pixel driving method further includes: in the initialization phase, the reset circuit writes an initialization voltage into the first electrode of the light emitting element under the control of the first gate driving signal output by the first gate line, so that the light emitting element does not emit light, and the residual charge of the first electrode of the light emitting element does not influence the display.

According to another specific embodiment, the pixel circuit may further include a reset circuit; the pixel driving method further includes: in the initialization phase, the reset circuit conducts the connection between the control end of the driving circuit and the second end of the driving circuit under the control of the first gate driving signal output by the first gate line, and the light emitting control circuit conducts the connection between the second end of the driving circuit and the first electrode of the light emitting element under the control of the second light emitting control signal, so that an initialization voltage is written into the first electrode of the light emitting element, the light emitting element does not emit light, and the residual charge of the first electrode of the light emitting element does not affect the display.

The display device of the embodiment of the disclosure includes the pixel circuit in N rows and multiple columns; N is an integer greater than 1.

According to a specific embodiment, the display device of the present disclosure further includes a gate driving circuit. The gate driving circuit includes N stages of gate driving unit circuits and a phase inversion circuit.

The nth stage of the gate driving unit circuit is used for providing a first gate driving signal for the pixel circuits in the nth row and providing a second gate driving signal for the pixel circuits in the (n−1) th row, and n is an integer which is greater than 1 and less than or equal to N.

The first stage of the gate driving unit circuit is used for providing a first gate driving signal for the pixel circuits in the first row. The phase inversion circuit is used for performing phase inversion on the first gate driving signal to obtain a first light emitting control signal, and performing phase inversion on the second gate driving signal to obtain a second light emitting control signal.

In specific implementation, the nth stage of gate driving unit circuit provides a first gate driving signal for pixel circuits in the nth row, the (n+1) th stage of gate driving unit circuit provides a second gate driving signal for the pixel circuits in the nth row, the phase inversion circuit inverts the first gate driving signal to obtain a first light emitting control signal and provides the first light emitting control signal to the pixel circuits in the nth row, and the phase inversion circuit inverts the second gate driving signal to obtain a second light emitting control signal and provides the second light emitting control signal to the pixel circuits in the nth row.

According to another specific embodiment, the display device of the present disclosure further comprises a gate driving circuit. The gate driving circuit includes N stages of gate driving unit circuits.

The nth stage of the gate driving unit circuit is used for providing a first gate driving signal and a first light emitting control signal for the pixel circuits in the nth row and providing a second gate driving signal and a second light emitting control signal for the pixel circuits in the (n−1) th row, and n is an integer greater than 1 and less than or equal to N.

The first stage of gate driving unit circuit is used for providing a first gate driving signal and a first light emitting control signal for the pixel circuits in the first row.

In a specific implementation, the first gate driving signal may be the same as the first light emitting control signal, and the second gate driving signal may be the same as the second light emitting control signal, where the gate driving circuit includes N stages of gate driving unit circuits, the nth stage of gate driving unit circuit provides the first gate driving signal and the first light emitting control signal for the pixel circuits in the nth row, and the (n+1)th stage of gate driving unit circuit provides the second gate driving signal and the second light emitting control signal for the pixel circuits in the nth row.

The display device does not need to specially set the GOA for generating the light emitting control signal, thereby saving the layout space and being beneficial to realizing a narrow frame.

The display device provided by the embodiment of the disclosure can be any product or component with a display function, such as a mobile phone, a tablet computer, a television, a display, a notebook computer, a digital photo frame, a navigator and the like.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display device comprising a plurality of pixel circuits in N rows and a plurality of columns, wherein N is an integer greater than 1, wherein each of the plurality of pixel circuits comprises:

a driving circuit comprising a control end, a first end and a second end, and configured to connect or disconnect the first end of the driving circuit and the second end of the driving circuit under the control of the control end of the driving circuit;

an energy storage circuit comprising a first end and a second end, and the first end of the energy storage circuit being connected to the control end of the driving circuit;

an initialization circuit, electrically connected to a first gate line and configured to write an initialization voltage into the control end of the driving circuit under the control of a first gate driving signal output by the first gate line, so as to control the driving circuit to conduct the connection between the first end of the driving circuit and the second end of the driving circuit;

a light emitting control circuit, electrically connected to a first light emitting control line and a second light emitting control line, and configured to conduct the connection between the first end of the driving circuit and a first voltage end under control of a first light emitting control signal output by the first light emitting control line, and conduct the connection between the second end of the driving circuit and a first electrode of a light emitting element under control of a second light emitting control signal output by the second light emitting control line; a second electrode of the light emitting element being connected to a second voltage end;

a compensation control circuit, electrically connected to a second gate line and configured to conduct the connection between the control end of the driving circuit and the second end of the driving circuit under the control of a second gate driving signal output by the second gate line;

a written-in control circuit, electrically connected to the second gate line and the second light emitting control line, and configured to write a data voltage into the second end of the energy storage circuit under the control of the second gate driving signal and write a reference voltage into the second end of the energy storage circuit under the control of the second light emitting control signal;

a reset circuit, electrically connected to the first gate line and configured to write the initialization voltage into a first electrode of the light emitting element under the control of the first gate driving signal output by the first gate line, so as to enable the light emitting element not to emit light; and a gate driving circuit, wherein the reset circuit is directly connected to the first electrode of the light emitting element, wherein the gate driving circuit comprises N stages of gate driving unit circuits;

the nth stage of the gate driving unit circuit is configured to provide the first gate driving signal and the first light emitting control signal to pixel circuits in the nth row, and provide the second gate driving signal and the second light emitting control signal to pixel circuits in the (n−1) th row, and n is an integer greater than 1 and less than or equal to N;

the first stage of gate driving unit circuit is configured to provide the first gate driving signal and the first light emitting control signal to pixel circuits in the first row, a phase of the first gate driving signal is inverted to a phase of the first light emitting control signal, a phase of the second gate driving signal is inverted to a phase of the second light emitting control signal.

2. The display device according to claim 1, wherein the reset circuit comprises a reset transistor;

the reset transistor comprises a control electrode, a first electrode and a second electrode; the control electrode of the reset transistor is connected to the first gate line, and the first electrode of the reset transistor is connected to an initialization voltage line; the second electrode of the reset transistor is connected to the first electrode of the light emitting element; the initialization voltage line is used to provide the initialization voltage.

3. The display device according to claim 1, wherein the driving circuit comprises a driving transistor; the energy storage circuit comprises a storage capacitor, and the light emitting element is an organic light emitting diode;

the driving transistor comprises a gate electrode, a first electrode and a second electrode; the gate electrode of the driving transistor is a control end of the driving circuit, the first electrode of the driving transistor is a first end of the driving circuit, and the second electrode of the driving transistor is a second end of the driving circuit;

the storage capacitor comprises a first end and a second end; the first end of the storage capacitor is a first end of the energy storage circuit, and the second end of the storage capacitor is a second end of the energy storage circuit; and the organic light emitting diode comprises an anode and a cathode; the anode of the organic light emitting diode is the first electrode of the light emitting element, and the cathode of the organic light emitting diode is the second electrode of the light emitting element.

4. The display device according to claim 1, wherein the initialization circuit comprises an initialization transistor; the initialization transistor comprises a control electrode, a first electrode and a second electrode;

the control electrode of the initialization transistor is connected to the first gate line, the first electrode of the initialization transistor is connected to a control end of the driving circuit, and the second electrode of the initialization transistor is connected to an initialization voltage line; the initialization voltage line is used for inputting the initialization voltage.

5. The display device according to claim 1, wherein the compensation control circuit comprises a compensation control transistor; the compensation control transistor comprises a control electrode, a first electrode and a second electrode; and the control electrode of the compensation control transistor is connected to the second gate line, the first electrode of the compensation control transistor is connected to the control end of the driving circuit, and the second electrode of the compensation control transistor is connected to the second end of the driving circuit.

6. The display device according to claim 1, wherein the light emitting control circuit comprises a first light emitting control transistor and a second light emitting control transistor;

the first light emitting control transistor comprises a control electrode, a first electrode and a second electrode; the control electrode of the first light emitting control transistor is connected to the first light emitting control line, the first electrode of the first light emitting control transistor is connected to the first voltage end, and the second electrode of the first light emitting control transistor is connected to the first end of the driving circuit;

the second light emitting control transistor comprises a control electrode, a first electrode, and a second electrode; the control electrode of the second light emitting control transistor is connected to the second light emitting control line, the first electrode of the second light emitting control transistor is connected to the second end of the driving circuit, and the second electrode of the second light emitting control transistor is connected to the first electrode of the light emitting element.

7. The display device according to claim 1, wherein the written-in control circuit comprises a data written-in transistor and a voltage written-in transistor, wherein, the data written-in transistor comprises a control electrode, a first electrode and a second electrode; the control electrode of the data written-in transistor is connected to the second gate line, the first electrode of the data written-in transistor is connected to the data line, and the second electrode of the data written-in transistor is connected to a second end of the energy storage circuit;

the voltage written-in transistor comprises a control electrode, a first electrode and a second electrode; and the control electrode of the voltage written-in transistor is connected to the second light emitting control line, the first electrode of the voltage written-in transistor is connected to the reference voltage end, and the second electrode of the voltage written-in transistor is connected to the second end of the energy storage circuit.

8. The display device according to claim 7, wherein the reference voltage end is the first voltage end or a ground end.

* * * * *